US009806437B2

(12) United States Patent
Scanzillo et al.

(10) Patent No.: US 9,806,437 B2
(45) Date of Patent: Oct. 31, 2017

(54) PUSH WIRE CONNECTORS

(71) Applicant: Hubbell Incorporated, Shelton, CT (US)

(72) Inventors: Thomas L. Scanzillo, Monroe, CT (US); Edward Bazayev, Kew Gardens, NY (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/058,308

(22) Filed: Mar. 2, 2016

(65) Prior Publication Data

US 2017/0256870 A1 Sep. 7, 2017

(51) Int. Cl.
*H01R 4/66* (2006.01)
*H01R 4/48* (2006.01)

(52) U.S. Cl.
CPC ..... *H01R 4/4818* (2013.01)

(58) Field of Classification Search
CPC .. H01R 4/4818; H01R 13/11; H01R 13/7135; H01R 25/003; H01R 24/76; H01R 27/00; H02G 3/22; H05K 5/02
USPC ..... 439/107
See application file for complete search history.

(56) References Cited

U.S. PATENT DOCUMENTS 2,466,930 A 4/1949 Cook
2,720,634 A 10/1955 Hart
3,093,433 A 6/1963 Ege
3,945,711 A 3/1976 Hohorst et al.
3,963,305 A 6/1976 Doktor et al.
4,563,054 A 1/1986 Wilmes
4,842,551 A * 6/1989 Heimann ..... H01R 27/00 174/58
5,454,730 A 10/1995 Tozuka
5,494,456 A 2/1996 Kozel et al.
5,679,021 A 10/1997 Kramer
5,735,700 A 4/1998 Hohorst
5,816,867 A 10/1998 Davidsz et al.
5,839,908 A * 11/1998 Bonilla ..... H01R 13/111 439/107
5,975,940 A 11/1999 Hartmann et al.
6,132,238 A 10/2000 Hartmann et al.
6,146,187 A 11/2000 Pallai
6,146,217 A 11/2000 Osada
6,155,890 A 12/2000 Gerberding
6,309,248 B1 * 10/2001 King ..... H01R 13/7135 361/42
6,464,545 B2 10/2002 Yano
6,634,898 B2 10/2003 Clements
6,682,364 B2 1/2004 Cisey
6,719,581 B2 4/2004 Kikuchi
6,746,286 B2 6/2004 Blaha
(Continued)

*Primary Examiner* — Jean F Duverne
(74) *Attorney, Agent, or Firm* — Wissing Miller LLP

(57) ABSTRACT

Configurations for push wire connectors and for electrical wiring devices that mate with or connect to the push wire connectors are disclosed. The push wire connectors have a housing and one or more contact assembly positioned within the housing. Each contact assembly has one or more contact openings to allow wires to pass through, and the housing has one or more wire entry openings that are angled so that wires that pass through the wire openings and the contact openings before engaging the contact assembly are angled.

25 Claims, 7 Drawing Sheets

(56) References Cited

U.S. PATENT DOCUMENTS 6,774,307 B2 * 8/2004 Kruse ..... H02G 3/22 174/53
6,814,608 B2 11/2004 Kollmann
6,832,938 B2 12/2004 Lenker
6,911,602 B2 6/2005 Conrad
6,981,890 B2 1/2006 Cutler et al.
6,994,585 B2 * 2/2006 Benoit ..... H01R 25/003 174/58
7,083,463 B2 8/2006 Steinkemper et al.
7,115,001 B1 10/2006 Brockman et al.
7,131,857 B2 11/2006 Mueller
7,140,887 B2 11/2006 Poh et al.
7,179,137 B1 2/2007 Quendt et al.
7,238,043 B2 7/2007 Reibke et al.
7,241,188 B2 7/2007 Lin et al.
7,249,963 B2 7/2007 Ramm
7,281,942 B2 10/2007 Swedberg et al.
7,384,319 B2 6/2008 Kirstein et al.
7,402,075 B1 7/2008 Probst
7,438,587 B2 10/2008 Germani
7,527,509 B1 5/2009 Bethurum et al.
7,628,640 B2 12/2009 Radle
7,645,158 B2 1/2010 Mulhouse et al.
7,651,363 B2 1/2010 Koellmann
7,690,952 B2 4/2010 Koellmann et al.
7,749,018 B1 * 7/2010 Benoit ..... H01R 25/003 174/58
7,794,268 B2 9/2010 Breen, IV et al.
7,815,463 B2 10/2010 Gerberding
7,845,970 B2 12/2010 Stromiedel
7,896,686 B2 3/2011 Hoppe
7,963,812 B2 6/2011 Ilkhanov
7,976,330 B2 7/2011 Lin
8,096,818 B2 1/2012 Arenas et al.
8,235,748 B2 8/2012 Lacey et al.
8,344,250 B2 * 1/2013 Padro ..... H01H 83/02 174/53
8,466,367 B2 6/2013 Reibke
8,771,008 B1 * 7/2014 Black ..... H01R 24/76 439/535
9,099,258 B2 * 8/2015 Padro ..... H01H 1/26
9,130,285 B2 * 9/2015 Scanzillo ..... H01R 4/4818
2002/0052139 A1 * 5/2002 Gorman ..... H01R 13/652 439/557
2013/0072046 A1 3/2013 Bazayev et al.
2013/0280956 A1 * 10/2013 Cheng ..... H05K 5/02 439/620.15
2014/0170877 A1 6/2014 Scanzillo et al.
2014/0170908 A1 6/2014 Scanzillo et al.

* cited by examiner

Fig. 8
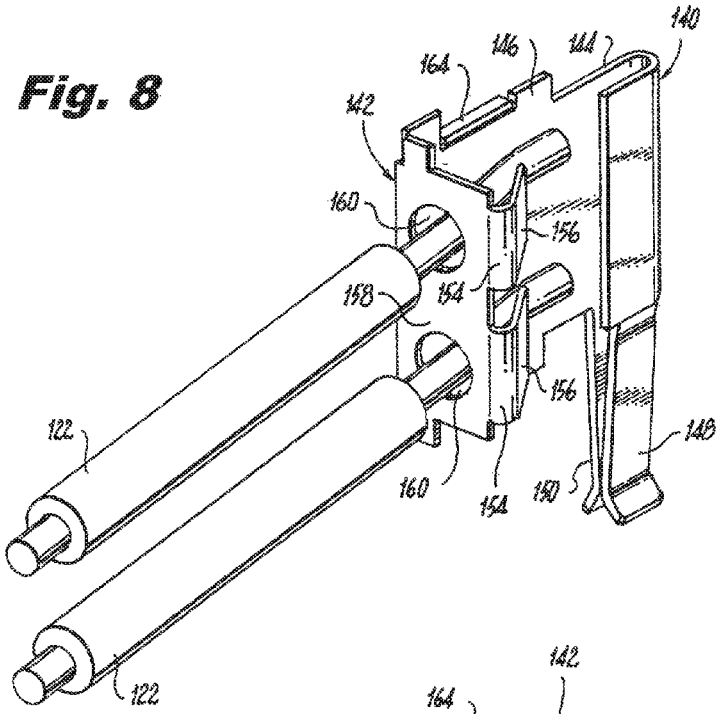
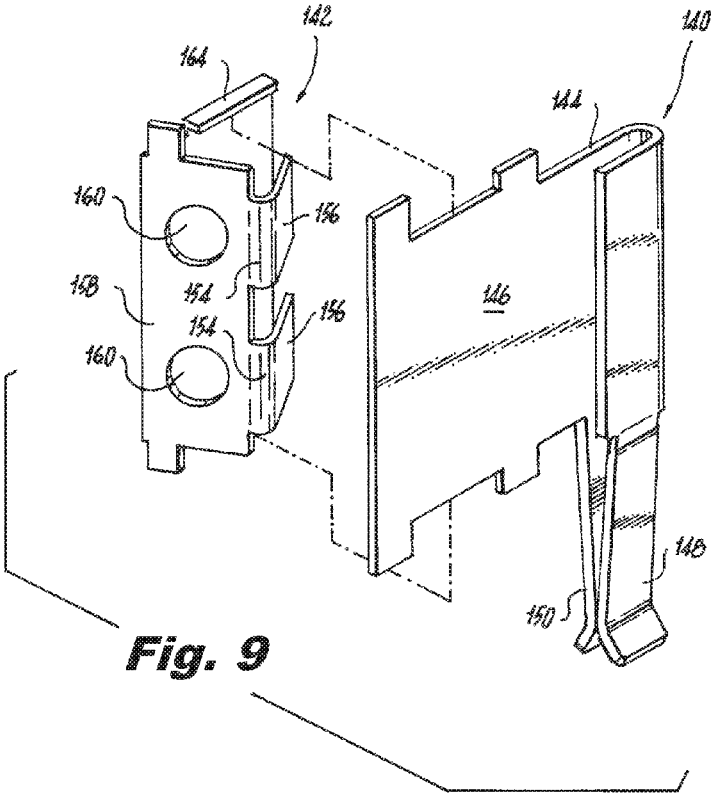
Fig. 9

PUSH WIRE CONNECTORS

BACKGROUND

Field

The present disclosure relates generally to push wire connectors for terminating electrical wires. More particularly, the present disclosure relates to push wire connectors for terminating electrical wires having a spring biasing member to facilitate electrically and mechanically engaging inserted electrical wires.

Description of the Related Art

Some electrical wiring devices have apertures in their rear faces for receiving a plug terminating a plurality of wires. The wires terminated by the plug are connected to existing building wires in any suitable manner, such as by a clamp receptacle or a twist-on wire connector. However, connecting each plug wire to a building wire with the twist-on wire connector, or similar device, requires time and skill to make the connection. Additionally, a significant amount of wire needs to be inserted in the electrical box when connecting the electrical receptacle to an electrical box. The large amount of wire can be difficult to pack into the electrical box with the electrical wiring device. Providing a plug that mates with an aperture in a rear surface of the electrical wiring device and terminates existing building wires through a push wire connection reduces time to install, and increase the area within an electrical box in which to pack electrical wires.

SUMMARY

Configurations for push wire connectors and for electrical wiring devices that mate with or connect to the push wire connectors are disclosed. Generally, the push wire connectors have a housing and one or more contact assembly positioned within the housing. Each contact assembly has one or more contact openings to allow wires to pass through, and the housing has one or more housing openings that are angled so that wires that pass through the housing openings and the contact openings before being clamped to the contact assembly are angled.

In one exemplary configuration, the push wire connector includes a housing and at least one contact assembly. The housing has at least one cavity, at least one housing wire opening extending between the at least one cavity and an outer surface of the housing, and a plug member for mating with an electrical wiring device. The at least one housing wire opening is arranged at an angle relative to the at least one cavity so that wires enter the housing at an angle. The plug member includes a portion of the at least one cavity, and has at least one slot for receiving a contact blade aligned with the portion of the at least one cavity.

The at least one contact assembly is positioned within the at least one cavity. The at least one contact assembly includes a contact member and a spring member. The contact member has a contact body and a contact extending from the contact body at least partially into the plug member. The spring member has an end portion coupled to the contact member, at least one spring arm for clamping a wire between the contact body and the spring arm, and an intermediate portion between the end portion and the at least one spring arm. The intermediate portion includes at least one contact wire opening aligned with the at least one spring arm and the at least one housing wire opening, such that a wire can pass through the housing wire opening and the contact wire opening at an angle relative to the at least one cavity into engagement with the at least one spring member.

In one exemplary configuration, an electrical device kit includes an electrical device and a push wire connector. The electrical device may be, for example, a duplex receptacle, a single receptacle, a circuit interrupting receptacle, a single pole switch, and a three way switch.

The push wire connector includes a housing and at least one contact assembly. The housing has at least one cavity, at least one housing wire opening extending between the at least one cavity and an outer surface of the housing, and a plug member for mating with an electrical wiring device. The at least one housing wire opening is arranged at an angle relative to the at least one cavity so that wires enter the housing at an angle. The plug member includes a portion of the at least one cavity, and has at least one slot for receiving a contact blade aligned with the portion of the at least one cavity.

The at least one contact assembly is positioned within the at least one cavity. The at least one contact assembly includes a contact member and a spring member. The contact member has a contact body and a contact extending from the contact body at least partially into the plug member. The spring member has an end portion coupled to the contact member, at least one spring arm for clamping a wire between the contact body and the spring arm, and an intermediate portion between the end portion and the at least one spring arm. The intermediate portion includes at least one contact wire opening aligned with the at least one spring arm and the at least one housing wire opening, such that a wire can pass through the housing wire opening and the contact wire opening at an angle relative to the at least one cavity into engagement with the at least one spring member.

BRIEF DESCRIPTION OF THE DRAWINGS

The figures depict configurations for purposes of illustration only. One skilled in the art will readily recognize from the following description that alternative configurations of the structures illustrated herein may be employed without departing from the principles described herein, wherein:

FIG. 8 is a top perspective view of a contact assembly of the push wire connector of FIG. 1, illustrating wires inserted into the contact assembly;

FIG. 9 is a top perspective view of the contact assembly of FIG. 8 with parts separated;

DETAILED DESCRIPTION

Figure 1:
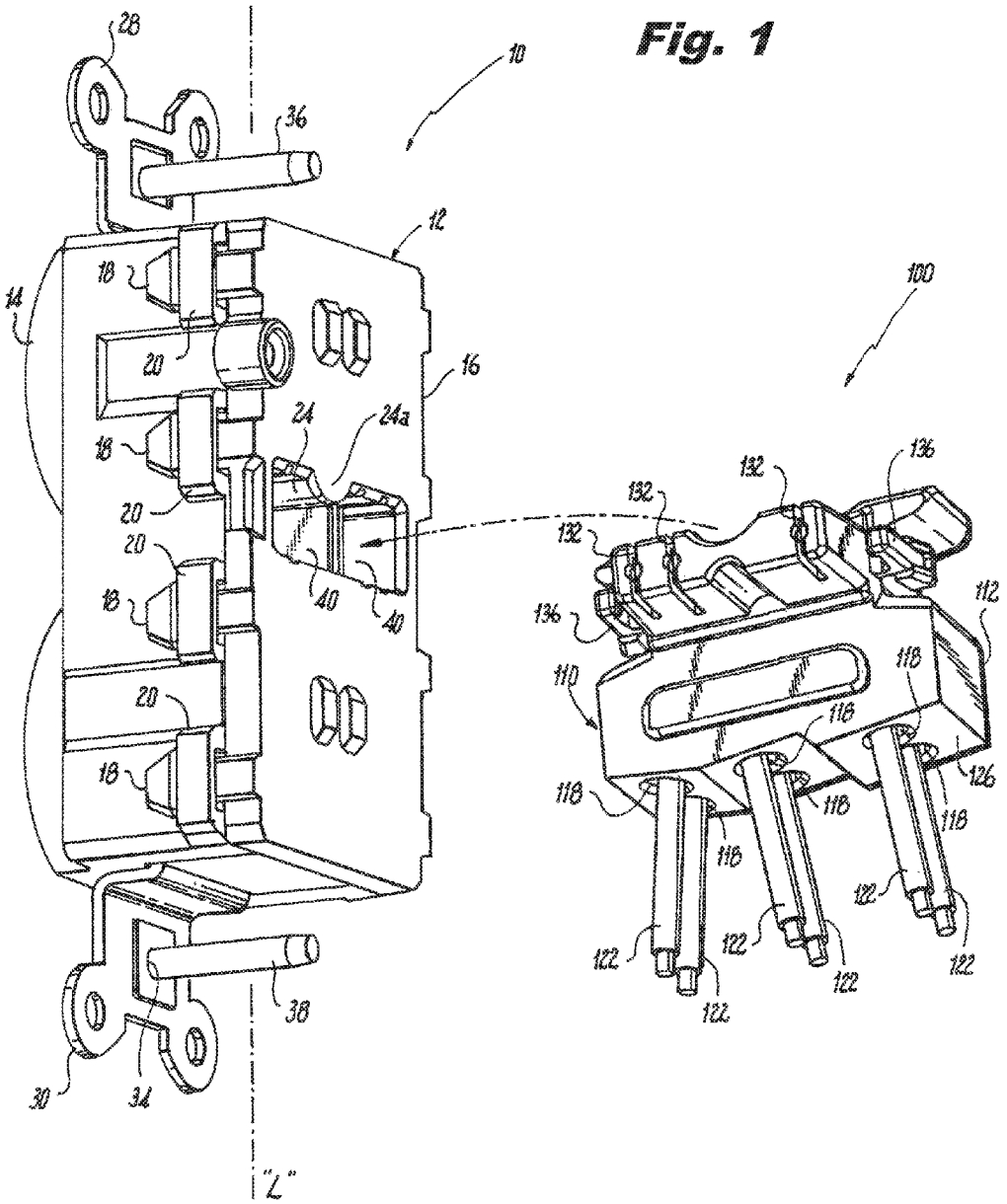
FIG. 1 is rear perspective view of an exemplary configuration of an electrical wiring device, and a front perspective view of an push wire connector according to the present disclosure that connects to the electrical wiring device.

The present disclosure provides descriptions of configurations for push wire connectors, and for electrical wiring devices that mate with or connect to the push wire connectors. Referring to FIG. 1, an exemplary configuration of an electrical wiring device 10 and a push wire connector 100 according to the present disclosure are shown. In this exemplary configuration, the electrical wiring device 10 includes a housing 12 having a cover 14 connected to a base 16. The base 16 can have a plurality of extending posts 18 that are received within pockets 20 of the cover 14 creating a snap fit to secure the cover 14 to the base 16. The base 16 has a rear surface 22, and an aperture 24 disposed in the rear surface. The aperture 24 is adapted to receive the push wire connector 100, as will be described in more detail below. A ground or mounting strap 26 is connected to the housing 12, and is adapted to secure the electrical wiring device 10 to an electrical box (not shown). The ground strap 26 has mounting ears 28 and 30 disposed at opposite ends of the ground strap. Each mounting ear 28 and 30 has an opening 32 and 34 to receive a fastener 36 and 38 used to secure the electrical wiring device 10 to an electrical box in a conventional manner. The ground strap 26 may be disposed between the cover 14 and the base 16, or the ground strap 26 may wrap around the rear surface 22 of the base 16 and up along the sides of the cover 14. Within the housing 12 are the known components that form the operational features of the electrical wiring device 10. For example, if the electrical wiring device 10 is a duplex receptacle, the internal components of the receptacle would include flexible fingers forming female contact assemblies that receive the blades of a plug, and the electrical connections between the female contact assemblies and their respective contact blades 40 described below.

The electrical wiring device 10 also includes a plurality of contact blades 40 disposed within the housing 12, and electrically connected to female contacts that are accessible through a front surface of the cover 14. The contact blades 40 are accessible through the aperture 24 in base 16. In the exemplary configuration of FIG. 1, the electrical wiring device 10 is a duplex receptacle, such that the cover 14 of the housing 12 has two sets of three openings to receive an electrical plug of an electrical apparatus or appliance to be powered by the electrical wiring device 10. For each of the two sets of openings, one of the three openings has a female contact assembly that connects to the hot leg of the power wires, one of the three openings has a female contact assembly that connects to the neutral leg of the power wires, and one of the three openings has a female contact assembly that connects to ground. Thus, in the configuration of FIG. 1, three contact blades 40 are disposed in the housing 12 and accessible via aperture 24. The three contact blades 40 are arranged so that two outer contact blades 40 correspond to hot and neutral contact assemblies within the housing 12, and a middle contact blade 40 corresponds to a ground contact assembly within the housing 12. When the push wire connector 100 is mated with the electrical wiring device, the hot contact assemblies would also be connected to the hot contact blade 40, the neutral contact assemblies would also be connected to the neutral contact blade 40, and the ground contact assemblies would also be connected to the ground contact blade 40.

While the configuration shown in FIG. 1 is described as having three contact blades 40, one skilled in the art would readily appreciate that any number of contact blades may be used in the electrical wiring device 10. A more detailed description of the electrical wiring device 10 is provided is commonly owned U.S. Pat. No. 9,130,285, which is incorporated herein in its entirety by reference. Further, the electrical wiring device shown in FIG. 1 and described herein is a duplex receptacle. However, the electrical wiring device 10 used with the push wire connector 100 may be, for example, a single receptacle, a circuit interrupting receptacle, e.g., a GFCI receptacle, a single pole switch, a three-way switch, a dimmer switch, or any similar electrical wiring device. Further, the number of contact blades 40 accessible through the aperture 24 would depend upon the particular electrical wiring device 10 that the push wire connector 100 is to connect to. For example, if the electrical wiring device 10 were a single pole switch, there would be three contact blades 40 accessible through the aperture 24. One contact blade would be for the hot leg, one contact blade would be for the neutral leg, and one contact blade would be for the ground. As another example, if the electrical wiring device 10 were a three-way switch, there would be four contact blades 40 accessible through the aperture 24. One contact blade would be for the hot leg, two contact blades would be for traveler legs, and one contact blade would be for the ground.

Figure 2:
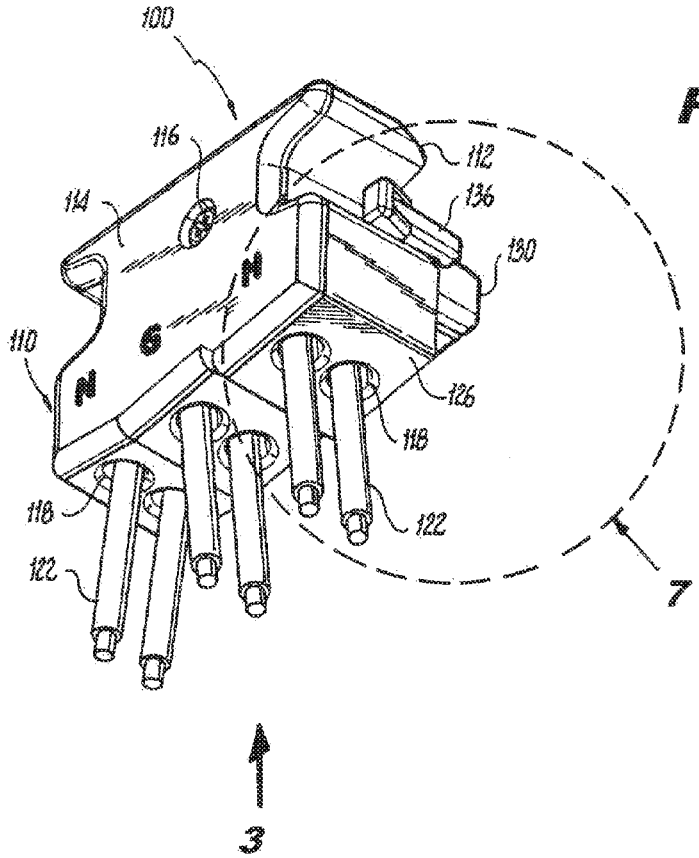
FIG. 2 is a rear perspective view of an exemplary configuration of the push wire connector of FIG. 1.
Figure 3:
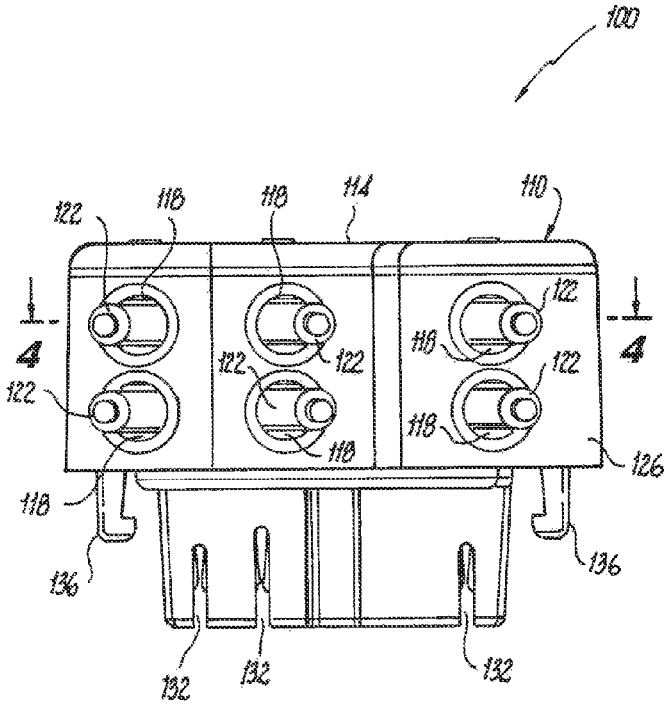
FIG. 3 is a bottom elevation view of the exemplary push wire connector of FIG. 1.
Figure 4:
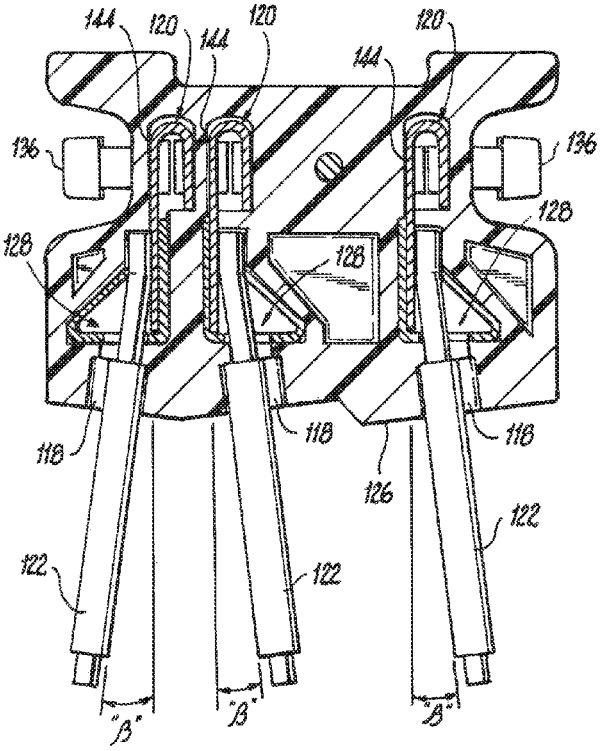
FIG. 4 is a cross-sectional view of the exemplary push wire connector of FIG. 3 taken along line 4-4.
Figure 5:
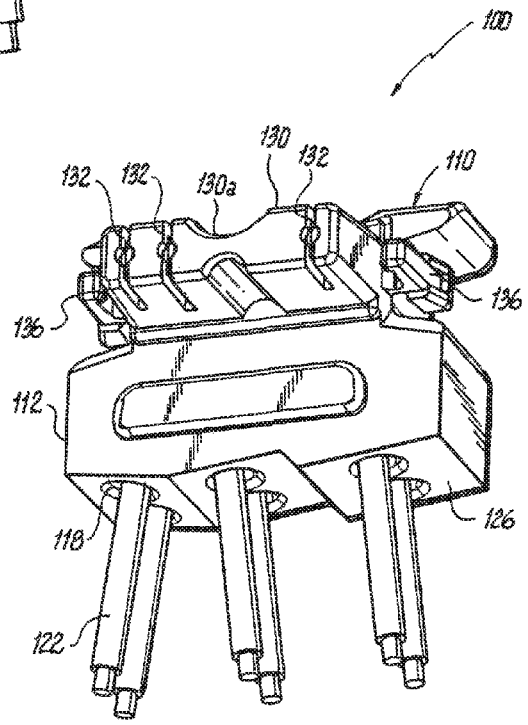
FIG. 5 is a bottom perspective view of the exemplary push wire connector of FIG. 1.
Figure 6:
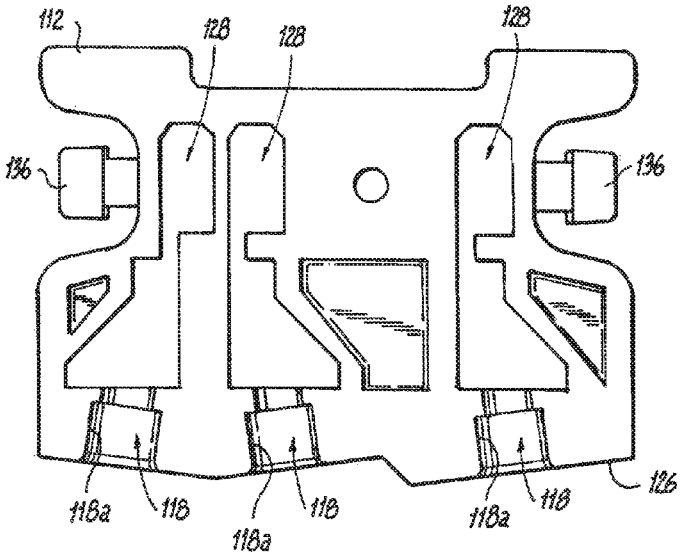
FIG. 6 is a plan view of a terminal housing of the push wire connector of FIG. 1 with a cover removed.

Referring now to FIGS. 2-7, the push wire connector 100 includes a terminal housing 110 and a plurality of contact assemblies 120 within the terminal housing. As seen in FIGS. 2 and 3, the terminal housing 110 has a base 112 and a cover 114 that connects to the base 112. The terminal housing 110 is preferably made of a non-conductive material, such as injection molded thermoplastic. The base 112 can be secured to the cover 114 using mechanical fasteners, adhesives, or welds such as sonic welds. In the configuration shown in FIG. 2, a mechanical fastener 116 secured to a mounting aperture in the base is used. The base 112 includes one or more cavities 128 configured to receive the contact assemblies 120, seen in FIGS. 4 and 6. In the configuration of FIGS. 2-7, the base 112 has three cavities 128, each configured to receive one contact assembly 120. However, one skilled in the art would readily recognize that the terminal housing 110 can have one cavity, two cavities, or more than three cavities in the base 112 that can receive one or more contact assemblies 120. A plurality of apertures or wire openings 118 are formed in the base 112 to receive power wires 122. The wire openings 118 are preferably disposed on the same side of the base 112, and extend from a bottom surface 126 of the base 112 to a respective cavity 128 within the base 112, as seen in FIGS. 4 and 6. Each wire opening 118 is angled relative to their respective cavity 128. The wire opening angle is set so that an angle "β" between an inside wall 118*a* of the wire opening 118 and a contact body 144 of the contact assembly 120, is in a range from about 1 degree to about 25 degrees. The angled wire openings 118 facilitates an angled entry of the wires into the contact assembly 120 which biases the wires, and acts like a strain relief to improve the tensile properties of the connector 100.

Figure 7:
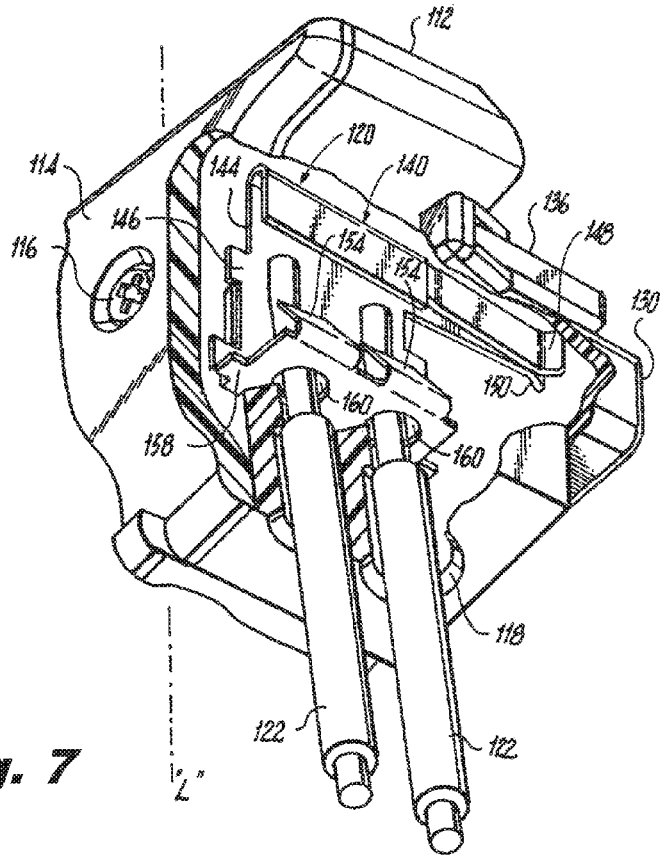
FIG. 7 is a cut-away view of a portion of the push wire connector of FIG. 2.

Referring to FIGS. 3, 5 and 7, the base 112 also includes a plug connector 130 that is configured to be inserted into the aperture 24 in the electrical wiring device 10, and mate with the contact blades 40. The plug connector 130 includes a portion of the cavity 128 for receiving flexible fingers 148 and 150 of the contact assembly 120. The flexible fingers 148 and 150 form a female contact that can receive a contact blade 40, which in this exemplary configuration is a male contact. The plug connector 130 also includes one or more openings or slots 132 to receive the contact blades 40 of an electrical wiring device 10, as will be described in more detail below.

The base 112 also includes a pair of latching arms 136. The latching arms 136 are disposed on opposite sides of the base 112, as shown in FIGS. 3 and 5. The latching arms 136 are flexible members that facilitate latching the push wire connector 100 to the electrical wiring device 10, and that facilitate unlatching the push wire connector 100 from the electrical wiring device 10. The latching arms 136 are configured to interact with overhangs 17 positioned on the sides of the base 16 adjacent to aperture 24, as seen in FIG. 1. Interaction between the overhangs 17 and the latching arms 136 releasable latches the push wire connector 100 to the electrical wiring device 10. More specifically, when the connector plug 130 of the push wire connector 100 is inserted into the aperture 24, the latching arms 136 flex away from the terminal housing 110 so that the latching arms 136 pass over the overhangs 17 on the base 16, and then snap back when the latching arms 136 pass beyond the overhangs 17. To release the push wire connector 100 from the electrical wiring device 10, the latching arms 136 are flexed away from the terminal housing 110 and the push wire connector 100 is pulled out of the aperture 24.

Referring now to FIGS. 8-13, an exemplary configuration of the contact assembly 120 according to the present disclosure is shown. In this exemplary configuration, the contact assembly 120 includes a contact member 140 and a spring member 142. The contact member 140 is made of an electrically conductive material, such as brass or aluminum. The contact member 140 includes a contact body 144 having a wire contacting surface 146, and a pair of flexible fingers 148 and 150 extending from the contact body 144, as shown in FIG. 8. The flexible fingers 148 and 150 form a female contact configured to engage a contact blade 40 in the electrical wiring device 10. The flexible fingers 148 and 150 of the contact member 140 contact each other to form a gripping portion 149 between the fingers, seen in FIG. 9, that is capable of receiving a contact blade 40, so as to electrically couple or connect the contact member 140 to the contact blade 40. Thus, each contact assembly 120 is adapted to engage one of the plurality of contact blades 40 in the electrical wiring device 10.

Figure 10:
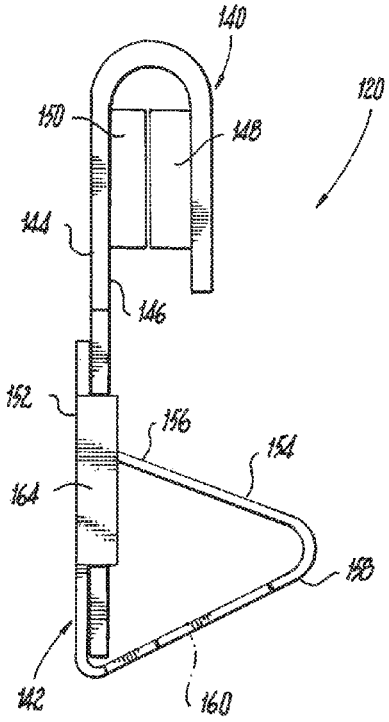
FIG. 10 is a side elevation view of the contact assembly of FIG. 8.

The spring member 142 has an end portion 152 that is substantially planar and contacts the contact body 144 of the contact member 140. The contact member 140 and the spring member 142 can be loosely interconnected such that the contact member 140 slides within tabs 164 of the end portion 152, as shown in FIGS. 9 and 10. With this loose fit, the contact assembly 120 can be installed within a cavity 128 in the terminal housing 110 and then when a wire 122 is inserted into the contact assembly 120 the spring action of the spring arms 154 (described below) create a tight connection between the contact member 140 and the spring member 142. In addition, having a loose interconnection between the contact member 140 and the spring member 142 permits different orientations of the spring member 142 relative to the contact member 140 such that the contact assembly 120 can be fitted for a left or right orientation during installation in the cavity. In another configuration, the contact member 140 can be secured to the spring member 142, by for example, wrapping the tabs 164 around the contact body 144, or by a spot weld joint or brazing.

Figure 11:
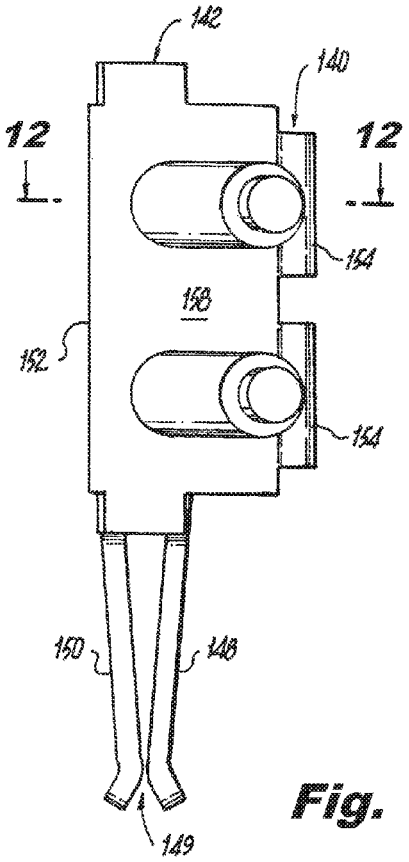
FIG. 11 is a bottom elevation view of the contact assembly of FIG. 8.
Figure 12:
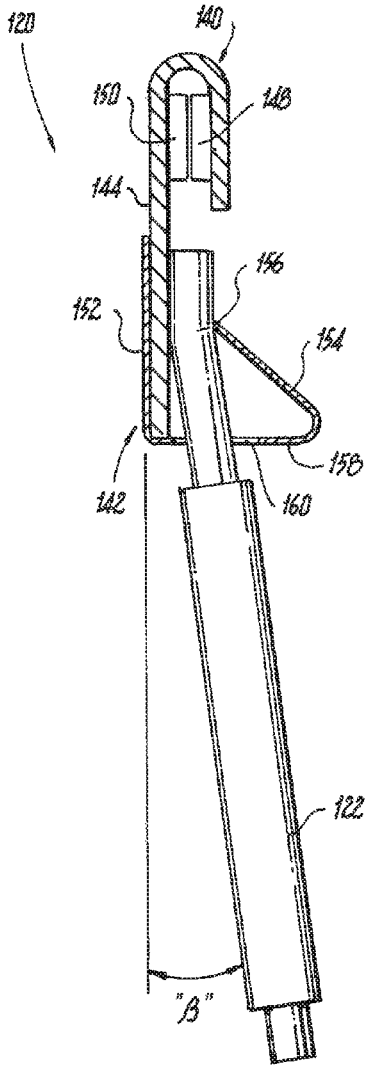
FIG. 12 is a cross-sectional view of the contact assembly of FIG. 11 taken along line 12-12.
Figure 13:
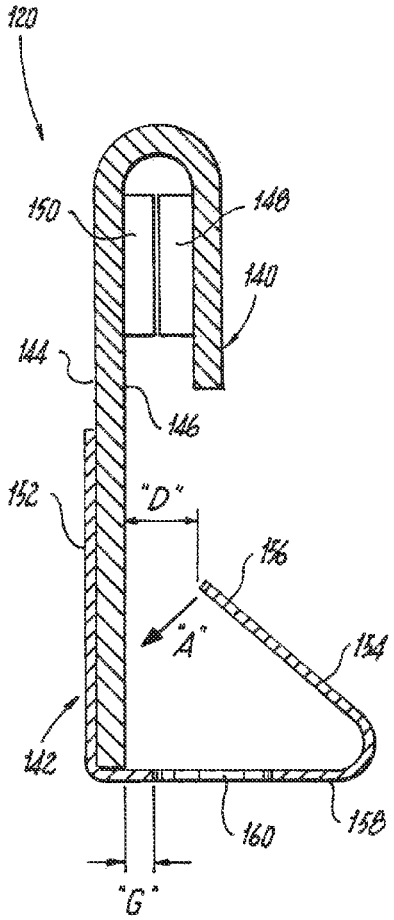
FIG. 13 is an enlarged view of the contact assembly of FIG. 12 without the wire inserted into the contact assembly.

The spring member 142 also has one or more spring arms 154 each having a wire contacting portion 156 that engages a wire inserted into the contact assembly 120. Each of the one or more spring arms 154 are configured so that they are normally biased in the direction of arrow "A" which is toward the end portion 152, as seen in FIG. 11. In the spring arm's normal position, the wire contacting portion 156 of the spring arm 154 is spaced a distance "D" from the contact body 144. The distance "D" is less than the diameter of the wire 122 the push wire connector 100 is designed to support. For example, if the electrical wiring device is rated for 15 amps, then the push wire connector should also be rated for at least 15 amps. The wire size (the bare conductor size) for 15 amp circuits is 14 AWG wire, such that the diameter "D" is less than the diameter of 14 AWG wire. As another example, if the electrical wiring device is rated for 20 amps, then the push wire connector should also be rated for at least 20 amps. The wire size (the bare conductor size) for 20 amp circuits is 12 AWG wire, such that the diameter "D" is less than the diameter of 12 AWG wire. The spring member 142 is made of a resilient material with sufficient stiffness to flex when a wire is pushed between the wire contacting surface 146 of the contact body 144, and the wire contacting portion 156 of the spring arm 154 while applying a biasing force (i.e., a spring force) to the wire so as to clamp the wire between the wire contacting surface 146 and the wire contacting portion 156. As an example, the spring arm 154 can be made of metal, such as spring steel. The biasing force exerted by the spring arm 154 clamping the wire 122 between the wire contacting surface 146 and the wire contacting portion 156 electrically couples or connects the contact assembly 120 to the wire 122.

Continuing to refer to FIGS. 8-11, between the end portion 152 and the one or more spring arms 154 is an intermediate portion 158. In this exemplary configuration, the intermediate portion 158 is substantially perpendicular to the end portion 152, and the one or more spring arms 154 are folded back towards the end portion 152, as shown in FIG. 11 to create the biasing force. The intermediate portion 158 has one or more wire openings 160 through which one or more wires 122 can pass through before engaging the wire contacting portion 156 of the spring arm 154. Each wire opening 160 in the intermediate member 158 is spaced a distance "G" from the contact body 144. The distance "G" creates a gap between the contact body 144 and a portion of the wire 122 passing through the wire opening 160, as seen in FIG. 10. The gap aligns the wire 122 with the angle "β" of the wire openings 118, and the combination of the gap and the angled wire opening 118 creates a bend in the wire 122 in an area of the wire that is in contact with the wire contacting portion 156 of the spring arm 154. This bend biases the wires and acts like a strain relief to improve the tensile properties of the connector 100.

As noted above, the spring member 142 may have one or more spring arms 154 for connecting one or more wires 122 to contact assembly 120. In the configuration shown in FIGS. 8-11, the spring member 142 has two spring arms 154, and each spring arm 154 has a corresponding wire opening 160, so that the spring member 142 is capable of receiving two wires 122. Thus, if an electrical box has line power wires, e.g., line hot, neutral and ground wires, and load (or feed through) power wires, e.g., load hot, neutral and ground wires, each contact assembly 120 would have two wires 122 inserted into the spring member 142, as seen in FIGS. 8 and 9.

As described herein, the push wire connector 100 uses the contact assemblies 120 to terminate power wires 122 within an electrical box. To connect power wires 122 within an electrical box to the push wire connector 100, an installer, e.g., an electrician, first strips the insulation from the end of each wire. The power wires 122 are then inserted into the appropriate wire opening 118 in the rear surface 126 of the base 112. The wire openings 118 guide the wire through the corresponding wire opening 160 in the spring member 142. When the bare end of the wire 122 contacts the wire contacting portion 156 of the corresponding spring arm 154, additional force is applied to the wire so that the wire contacting portion 156 flexes away from the wire contacting surface 146 of the contact body 144. The flexion of the wire contacting portion 156 allows the bare end of the wire to slide between the wire contacting surface 146 and the wire contacting portion 156. The normal bias of the spring arm 154, which is in the direction of arrow "A," applies a continuous spring force on the wire 122 so that the wire is clamped between wire contacting surface 146 and the wire contacting portion 156. Clamping the wire 122 electrically couples or connects the wires to the contact assembly 120.

Preferably, the push wire connector 100 has three contact members 120 corresponding to the hot, neutral and ground power wires 122. Each contact member 120 has a spring member 142 with two spring arms 154. Each spring arm 154 is aligned with a corresponding wire opening 160 in the intermediate portion 158. As a result, the push wire connector 100 can terminate six wires—two hot wires, two neutral wires and two ground wires.

To connect or mate the push wire connector 100 to the electrical wiring device 10, the installer aligns the connector plug 130 with the aperture 24 in the electrical wiring device 10. In the configuration of the connector plug 130 shown in FIG. 5, the connector plug 130 may include a keyway, e.g., an arched portion 130*a*, that aligns with a key, e.g., an inverted arch 24*a*, in the rear surface 22 of the base 16 to ensure that the connector plug 130 is properly aligned with the aperture 24. When the connector plug 130 is properly aligned with the aperture 24, force is applied to the terminal housing 110 so that the connector plug 130 enters the aperture 24, as contact blades 40 slide into the slots 132 in the connector plug 130 and between the flexible fingers 148 and 150. When the connector plug 130 of the push wire connector 100 is fully within the aperture 24, the latching arms 136 flex away from the terminal housing 110 so that the latching arms 136 pass over the overhangs 17 on the base 16, and then snap back when the latching arms 136 pass beyond the overhangs 17. At this point, the push wire connector 100 is latched to the electrical wiring device 10. To release the push wire connector 100 from the electrical wiring device 10, the latching arms 136 are flexed away from the terminal housing 110 and the push wire connector 100 is pulled out of the aperture 24.

The wires 122 terminated by the push wire connector 100 extend from the base 112 of the terminal housing 110 and substantially perpendicular to the connector plug 130, as seen in FIG. 5. As such, the plurality of wires 122 are substantially parallel to a longitudinal axis of the electrical wiring device 10 when the push wire connector 100 is connected to the electrical wiring device 10. Having the wires 122 substantially parallel to a longitudinal axis of the electrical wiring device provide more area within an electrical box in which to mount the electrical wiring device. Alternatively, the wires 122 can be terminated such that the wires extend from the base 112 of the terminal housing 110 and are substantially perpendicular to the longitudinal axis of the electrical wiring device 10.

Using the electrical wiring device and push wire connector of the present disclosure, power wires can be quickly and easily inserted into the push wire connector, and the push wire connecter can be quickly and easily connected to the electrical wiring device. As a result, electrical continuity can be established between the existing power wires and the electrical wiring device quickly and easily. While illustrative configuration s of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

What is claimed is:

1. A push wire connector, comprising:

a housing comprising:

at least one cavity;

at least one housing wire opening extending between the at least one cavity and an outer surface of the housing, wherein the at least one housing wire opening is arranged at an angle relative to the at least one cavity; and a plug member for mating with an electrical wiring device, wherein at least a portion of the plug member includes a portion of the at least one cavity, and wherein the plug member has at least one slot for receiving a contact blade aligned with the portion of the at least one cavity; and at least one contact assembly positioned within the at least one cavity, the at least one contact assembly comprising:

a contact member having a contact body and a contact extending from the contact body at least partially into the plug member; and a spring member having an end portion coupled to the contact member, at least one spring arm for clamping a wire between the contact body and the spring arm, and an intermediate portion between the end portion and the at least one spring arm, wherein the intermediate portion includes at least one contact wire opening aligned with the at least one spring arm and the at least one housing wire opening, such that a wire can pass through the housing wire opening and the contact wire opening at an angle relative to the at least one cavity into engagement with the at least one spring member.

2. The push wire connector according to claim 1, wherein at least one cavity comprises a first cavity, a second cavity and a third cavity.

3. The push wire connector according to claim 2, wherein the at least one housing wire opening comprises three housing wire openings, wherein a first housing wire openings extends between the first cavity and the outer surface of the housing and is arranged at an angle relative to the first cavity, wherein a second housing wire openings extends between the second cavity and the outer surface of the housing and is arranged at an angle relative to the second cavity, and wherein a third housing wire openings extends between the third cavity and the outer surface of the housing and is arranged at an angle relative to the third cavity.

4. The push wire connector according to claim 2, wherein the plug member has three slots, wherein a first slot is aligned with a portion of the first cavity, a second slot is aligned with a portion of the second cavity, and a third slot is aligned with a portion of the third cavity.

5. The push wire connector according to claim 2, wherein the at least one contact assembly comprises a first contact assembly positioned in the first cavity, a second contact assembly positioned in the second cavity, and a third contact assembly positioned in the third cavity.

6. The push wire connector according to claim 5, wherein the spring member in the first contact assembly has two spring arms and the intermediate member in the first contact assembly has two contact wire openings, wherein a first spring arm is aligned with a first contact wire opening and one of the housing wires openings in the first set, and a second spring arm is aligned with a second contact wire opening and one of the housing wire openings in the first set.

7. The push wire connector according to claim 5, wherein the spring member in the second contact assembly has two spring arms and the intermediate member in the second contact assembly has two contact wire openings, wherein a first spring arm is aligned with a first contact wire opening and one of the housing wires openings in the second set, and a second spring arm is aligned with a second contact wire opening and one of the housing wire openings in the second set.

8. The push wire connector according to claim 5, wherein the spring member in the third contact assembly has two spring arms and the intermediate member in the third contact assembly has two contact wire openings, wherein a first spring arm is aligned with a first contact wire opening and one of the housing wires openings in the third set, and a second spring arm is aligned with a second contact wire opening and one of the housing wire openings in the third set.

9. The push wire connector according to claim 2, wherein the at least one housing wire opening comprises a first set of housing wire openings, a second set of housing wire openings, and a third set of housing wire openings, wherein each housing wire opening in the first set extends between the first cavity and the outer surface of the housing and is arranged at an angle relative to the first cavity, wherein each housing wire opening in the second set extends between the second cavity and the outer surface of the housing and is arranged at an angle relative to the second cavity, and wherein each housing wire opening in the third set extends between the third cavity and the outer surface of the housing and is arranged at an angle relative to the third cavity.

10. The push wire connector according to claim 9, wherein the first set of housing wire openings comprises two housing wire openings, the second set of housing wire openings comprises two housing wire openings, and the third set of housing wire openings comprises two housing wire openings.

11. An electrical device kit comprising:

an electrical device; and a push wire connector, comprising:

a housing comprising:

at least one cavity;

at least one housing wire opening extending between the at least one cavity and an outer surface of the housing, wherein the at least one housing wire opening is arranged at an angle relative to the at least one cavity; and a plug member for mating with an electrical wiring device, wherein at least a portion of the plug member includes a portion of the at least one cavity, and wherein the plug member has at least one slot for receiving a contact blade aligned with the portion of the at least one cavity; and at least one contact assembly positioned within the at least one cavity, the at least one contact assembly comprising:

a contact member having a contact body and a contact extending from the contact body at least partially into the plug member; and a spring member having an end portion coupled to the contact member, at least one spring arm for clamping a wire between the contact body and the spring arm, and an intermediate portion between the end portion and the at least one spring arm, wherein the intermediate portion includes at least one contact wire opening aligned with the at least one spring arm and the at least one housing wire opening, such that a wire can pass through the housing wire opening and the contact wire opening at an angle relative to the at least one cavity into engagement with the at least one spring member.

12. The electrical device kit according to claim 11, wherein at least one cavity comprises a first cavity, a second cavity and a third cavity.

13. The electrical device kit according to claim 12, wherein the at least one housing wire opening comprises three housing wire openings, wherein a first housing wire openings extends between the first cavity and the outer surface of the housing and is arranged at an angle relative to the first cavity, wherein a second housing wire openings extends between the second cavity and the outer surface of the housing and is arranged at an angle relative to the second cavity, and wherein a third housing wire openings extends between the third cavity and the outer surface of the housing and is arranged at an angle relative to the third cavity.

14. The electrical device kit according to claim 12, wherein the plug member has three slots, wherein a first slot is aligned with a portion of the first cavity, a second slot is aligned with a portion of the second cavity, and a third slot is aligned with a portion of the third cavity.

15. The electrical device kit according to claim 12, wherein the at least one contact assembly comprises a first contact assembly positioned in the first cavity, a second contact assembly positioned in the second cavity, and a third contact assembly positioned in the third cavity.

16. The electrical device kit according to claim 15, wherein the spring member in the first contact assembly has two spring arms and the intermediate member in the first contact assembly has two contact wire openings, wherein a first spring arm is aligned with a first contact wire opening and one of the housing wires openings in the first set, and a second spring arm is aligned with a second contact wire opening and one of the housing wire openings in the first set.

17. The electrical device kit according to claim 15, wherein the spring member in the second contact assembly has two spring arms and the intermediate member in the second contact assembly has two contact wire openings, wherein a first spring arm is aligned with a first contact wire opening and one of the housing wires openings in the second set, and a second spring arm is aligned with a second contact wire opening and one of the housing wire openings in the second set.

18. The electrical device kit according to claim 15, wherein the spring member in the third contact assembly has two spring arms and the intermediate member in the third contact assembly has two contact wire openings, wherein a first spring arm is aligned with a first contact wire opening and one of the housing wires openings in the third set, and a second spring arm is aligned with a second contact wire opening and one of the housing wire openings in the third set.

19. The electrical device kit according to claim 12, wherein the at least one housing wire opening comprises a first set of housing wire openings, a second set of housing wire openings, and a third set of housing wire openings, wherein each housing wire opening in the first set extends between the first cavity and the outer surface of the housing and is arranged at an angle relative to the first cavity, wherein each housing wire opening in the second set extends between the second cavity and the outer surface of the housing and is arranged at an angle relative to the second cavity, and wherein each housing wire opening in the third set extends between the third cavity and the outer surface of the housing and is arranged at an angle relative to the third cavity.

20. The electrical device kit according to claim 19, wherein the first set of housing wire openings comprises two housing wire openings, the second set of housing wire openings comprises two housing wire openings, and the third set of housing wire openings comprises two housing wire openings.

21. The electrical device kit according to claim 11, wherein the electrical device comprises a duplex receptacle.

22. The electrical device kit according to claim 11, wherein the electrical device comprises a single pole switch.

23. The electrical device kit according to claim 11, wherein the electrical device comprises a three way switch.

24. The electrical device kit according to claim 11, wherein the electrical device comprises a single receptacle.

25. The electrical device kit according to claim 11, wherein the electrical device comprises a circuit interrupting receptacle.

* * * * *